US005647808A

United States Patent [19]

Hosokawa

[11] Patent Number: 5,647,808

[45] Date of Patent: Jul. 15, 1997

[54] DRIVER HEAD FOR GOLF

[75] Inventor: Toshihiro Hosokawa, Izumi, Japan

[73] Assignee: Kabushiki Kaisha Hosokawaseisakusho, Izumi, Japan

[21] Appl. No.: 644,945

[22] Filed: May 13, 1996

[51] Int. Cl.[6] ..... A63B 53/04

[52] U.S. Cl. ..... 473/349; 473/342; 473/346

[58] Field of Search ..... 473/324, 335, 473/342, 344, 345, 346, 347, 348, 349; 273/167 R, 172, 167 H

[56] References Cited

U.S. PATENT DOCUMENTS

| | | | |
|---|---|---|---|
| 4,181,306 | 1/1980 | Jepson | 473/342 |
| 4,204,684 | 5/1980 | Molitor | 473/349 |
| 4,326,716 | 4/1982 | LaCoste | 473/349 |
| 4,984,800 | 1/1991 | Hamada | 473/347 |
| 5,007,643 | 4/1991 | Okumoto | 473/346 |
| 5,016,883 | 5/1991 | Kobayashi | 473/349 |
| 5,024,437 | 6/1991 | Anderson | 473/342 |
| 5,135,227 | 8/1992 | Okumoto | 473/346 |
| 5,281,251 | 1/1994 | Kenny | 75/415 |

*Primary Examiner*—Sebastiano Passaniti
*Assistant Examiner*—Stephen Luther Blau
*Attorney, Agent, or Firm*—Curtis L. Harrington

[57] ABSTRACT

A driver head for golf of which main body is a core member, the core member comprising a required number of small pieces of aluminum plate or small masses of foamed aluminum, the small pieces of aluminum plate or small masses of foamed aluminum being put into a mold for compression molding and welded to each other by use of an electric current.

5 Claims, 2 Drawing Sheets

DRIVER HEAD FOR GOLF

FIELD OF THE INVENTION

This invention relates to a driver head for golf which can transmit, through the shaft, the feeling of making a golf shot similar to that of a persimmon club head to the user's hands so that the user can improve in playing golf, causes little joint trouble to the user's elbows because of the soft feel at impact, and can be readily produced.

The present inventor has already proposed a metal wood club head having a metal outer shell having a hollow portion and foamed metal arranged in the hollow portion. (Japanese patent application No. 7-124469)

The metal wood club head of Japanese patent application No. 7-124469 can transmit through the shaft to the user's hands the feeling of where on the club face the ball was hit similar to persimmon club heads to promote the user's progress in playing golf and causes little joint trouble to the user's elbows, since a main body of the club head arrangement, inside thereof, is foamed metal which is light and has superb absorptivity at impact. The above-mentioned metal wood club head, however, has some problems as follows.

Specific gravity of foamed metal (especially foamed aluminum) is no more than 0.2–0.3 because of the restriction in manufacturing of foamed metal so that, for producing a club head with a certain weight, foamed metal should be covered with metal. Then the construction of the club head becomes more complicated, resulting in a prohibitive cost of production for the club head.

In addition, foamed metal is usually available as a square block so that the steps for producing the club head become further complicated and result in a higher cost due to the secondary process of shaping the square block of foamed metal to fit inside the club head. The present inventor had researched diligently the production of a driver head of more simple construction having superior qualities the same as those which are the subject of Japanese patent application No. 7-124469 and has invented a driver head for golf relating to the present invention.

SUMMARY OF THE INVENTION

The present invention relates to a driver head of which a main body is a core member, the core member having a required number of small pieces of aluminum plate or small masses of foamed aluminum, the small pieces of aluminum plate or small masses of foamed aluminum being put into a mold for compression molding and welded to each other by use of an electric current.

Therefore a main body of a specific gravity almost the same as that of persimmon club heads can be produced without any secondary processing, and the main body is porous metal with spaces or pores dispersed so that the driver head has the characteristic that the driver head can transmit through the shaft to the user's hands the feeling indicating where on the club face the ball was hit, similar to the characteristic of persimmon club heads which promote the user's progress in playing golf. The soft feel at impact results in less trouble to the user's elbow and other joints.

The present invention has a second aspect which relates to a driver head of which a main body is a core member, the core member having a required number of small pieces of aluminum plate or small masses of foamed aluminum, the small pieces of aluminum plate or small masses of foamed aluminum being put into a mold for compression molding and welded to each other by use of an electric current, wherein at least a face portion and a sole portion of the main body are covered with another material. Therefore the driver head has the characteristic in addition to those of the invention of the first embodiment that the user can hit a stable shot with the driver head. The driver head has a superior strength at hitting a ball since at least a face portion and a sole portion of the main body is covered with another material such as metal and the like.

The present invention has a third aspect which relates to a driver head of which a main body is a core member, the core member having a required number of small pieces of aluminum plate or small masses of foamed aluminum over which thermosetting adhesive is distributed, the small pieces of aluminum plate or small masses of foamed aluminum being put into a mold to be molded by heat compression. Therefore a main body of a specific gravity almost the same as that of persimmon club heads can be produced without any secondary process and the main body is porous metal with spaces or pores dispersed so that the driver head has the effect that the driver head can transmit through the shaft to the user's hands the feeling indicative of where on the club face the ball was hit similar to the feeling produced by persimmon club heads to promote the user's progress in playing golf. The soft feel at impact results in less trouble to the user's elbow and other joints.

The present invention has a fourth aspect which relates to a driver head of which main body is a core member, the core member having a required number of small pieces of aluminum plate or small masses of foamed aluminum over which thermosetting adhesive is distributed, the small pieces of aluminum plate or small masses of foamed aluminum being put into a mold to be molded by heat compression, wherein at least a face portion and a sole portion of the main body are covered with another material. Therefore the driver head has the characteristic in addition to those of the invention of the third embodiment that the user can hit a stable shot with the driver head, and the driver head has a superior strength at hitting a ball since at least a face portion and a sole portion of the main body is covered with another material such as metal and the like.

The present invention has a further aspect which relates to a driver head which has a metal outer shell having a hollow portion and a core arranged in the hollow portion, the core having a required number of small pieces of aluminum plate or small masses of foamed aluminum over which thermosetting adhesive is distributed, the small pieces of aluminum plate or small masses of foamed aluminum being put into a mold to be molded by heat compression. Therefore the driver head has the structure that a core having porous metal with spaces or pores dispersed which is light and has a superior absorptivity at impact can be produced without any secondary processing, the driver head can transmit through the shaft to the user's hands the feeling relating to where on the club face the ball was hit similar to persimmon club heads to promote the user's progress in playing golf since the core is arranged inside the driver head, and its soft feel at impact results in less trouble to the user's elbow and other joints.

BRIEF DESCRIPTION OF THE DRAWINGS

The invention, its configuration, construction, and operation will be best further described in the following detailed description, taken in conjunction with the accompanying drawings in which.

Figure 1:
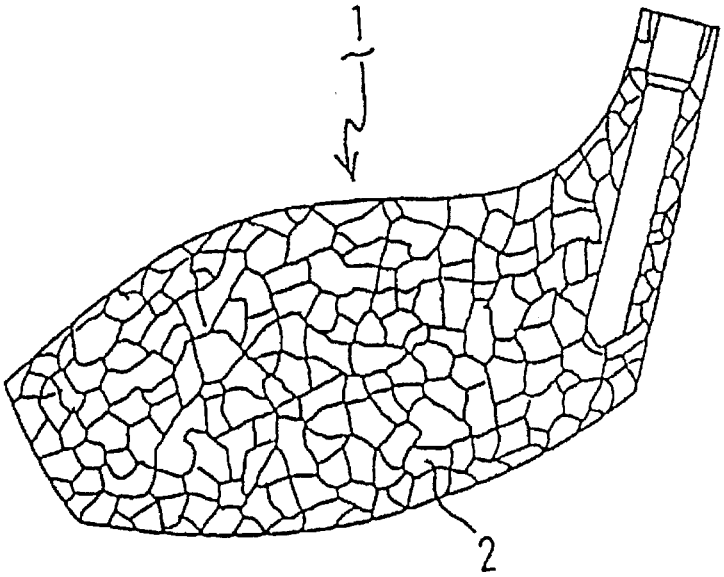
FIG. 1 is a sectional view showing one embodiment of a driver head for golf relating to the present invention.

Within the drawings, the numerical symbols are as follows:

1 ~Driver head for golf

2 ~Main body of driver head

3 ~Face plate

4 ~Sole plate

5 ~Outer shell

6 ~Core

DETAILED DESCRIPTION OF THE PREFERRED EMBODIMENT

Referring to the drawings, a driver head for golf relating to the present invention will be described hereinafter. Referring to FIG. 1, a sectional view showing one embodiment of a driver head for golf relating to the present invention is illustrated. In this embodiment, a main body 2 of driver head 1 is produced by putting a required number of small pieces of aluminum plate or small masses of foamed aluminum into a mold for compression molding and then welding the small pieces of aluminum plate or small masses of foamed aluminum to each other by use of an electric current.

It is preferred to calculate the size and number of the small pieces of aluminum plate or small masses of foamed aluminum to have a specific gravity thereof to be about 0.9 after compression molding. Thus a driver head of a specific gravity the same as that of persimmon club heads can be produced.

Foamed aluminum is one kind of foamed metal which means a light metal composite with superb absorptivity at impact being porous and having independent or sequential foams dispersed as cells.

For preparing foamed metal, a method can be shown as an example such that particles as foaming agent such as a hydride or natural mineral are added to and mixed with molten metal thickened by means of alloying, oxidation, dispersion of ceramic particles and so on. The hydride or natural mineral as foaming agent generates gas at about melting point of the molten metal, such that the generated gas is kept in the molten metal.

There is another example of foamed metal where calcium is added to molten metal to be oxidized and thickened by stirring, and titanium hydride is added to and mixed with the molten metal to keep decomposed hydrogen gas produced within the metal.

There is still another method to foam both metal with a high melting point such as copper, iron and so on, and metal with a low melting point such as aluminum and so on, as follows. Gas is dissolved under atmospheric pressure into molten metal thickened through a method according to the kind of the molten metal used, by blowing hydrogen, nitrogen, oxygen or mixed gas thereof into the molten metal or dispersing and mixing particles of hydrides, nitrides, oxides or minerals with water content etc. which generates gas by thermal decomposition into the molten metal by stirring. The pressure is then reduced to below −400 mm Hg to foam the molten metal.

Of the foamed metal thus produced, for example foamed aluminum, has an apparent specific gravity of about 0.2–0.3 and porosity of about 65–78%. The foamed metal is light and has superb absorptivity at impact because the foamed metal is porous and has independent or sequential foams dispersed as cells.

As for the driver head of the present invention, the specific gravity of foamed aluminum can be increased from about 0.2–0.3 to about 0.9 by compression molding of a required number of small masses of foamed aluminum in a mold to produce, even without covering main body 2 with metal, a driver head of a specific gravity almost the same as that of persimmon club heads. After compression molding, the small masses of foamed aluminum are welded to each other by use of an electric current so that a molding can be formed integrally with a superb strength.

For preparing main body 2, another method can be shown as an example such that the required number of small pieces of aluminum plate or small masses of foamed aluminum over which thermosetting adhesive is distributed are put into a mold to be molded by heat-compression.

Through the above mentioned method, a driver head of a specific gravity almost the same as that of persimmon club heads can also be produced without covering main body 2 with metal. The produced driver head has superior strength since the small pieces of aluminum plate or small masses of foamed aluminum are solidified integrally to each other with thermosetting adhesive.

There is no limitation for the thermosetting adhesive to be used and phenol resin adhesive, urea resin adhesive, melamine resin adhesive, furan resin adhesive, silicone resin adhesive, epoxy resin adhesive, polyester resin adhesive and so on can be shown as favorable examples.

Figure 2:
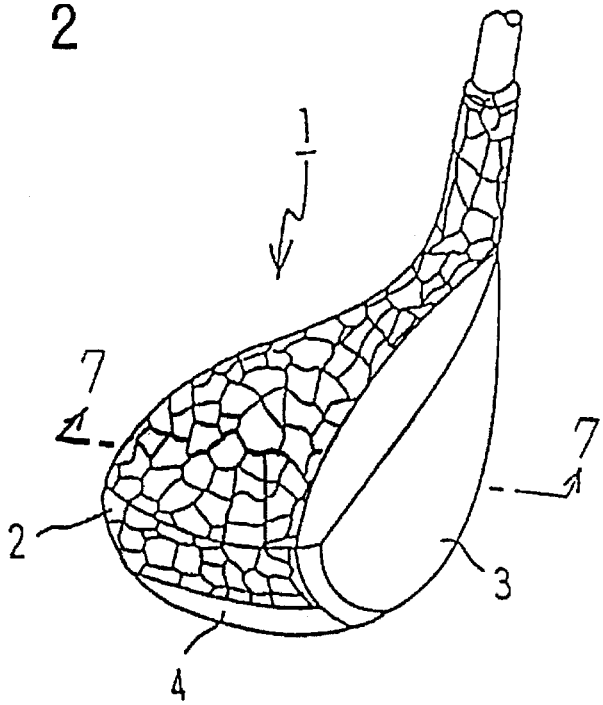
FIG. 2 is an outer view showing another embodiment of a driver head for golf relating to the present invention.
Figure 3:
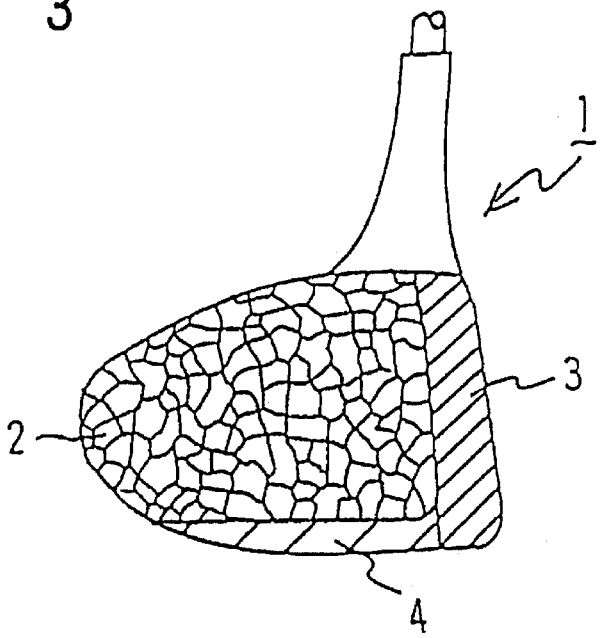
FIG. 3 is a sectional view taken along line 7—7 of FIG. 2.

Referring to FIG. 2, an outer view showing another embodiment of driver head 1 relating to the present invention is illustrated. FIG. 3 is a sectional view taken along line 7—7 of FIG. 2.

In driver head 1 relating to this embodiment, a face portion and a sole portion of main body 2 is covered with metal material to form a face plate 3 and sole plate 4, respectively.

As a method for preparing main body 2, any of the above mentioned methods can be favorably adopted, however, it is preferable to calculate the size and number of small pieces of aluminum plate or small masses of foamed aluminum for a specific gravity of main body 2 to be rather less than 0.9 after compression molding. Then, a specific gravity of the driver head will be about 0.9, almost the same as that of persimmon club heads, with the face portion and the sole portion covered with metal material after compression molding.

As for the material of face plate 3 and sole plate 4, any materials generally used for driver heads can be used. Specifically, stainless alloy, aluminum alloy, titanium or titanium alloy are preferred. Among them, titanium or titanium alloy are more favorably used due to their small specific gravity relative to that of other materials, high strength and superior durability and impact resiliency. More specifically, preferable examples include Ti-Al alloy, Ni-Ti alloy, Ti-6Al-4V alloy, Ti-4.5Al-3V-2Fe-2Mo alloy and the like.

To unite main body 2 with face plate 3 and sole plate 4 integrally, any suitable means such as welding, adhesion, pressure welding, brazing, and fastening with bolts or rivets can be adopted.

Figure 4:
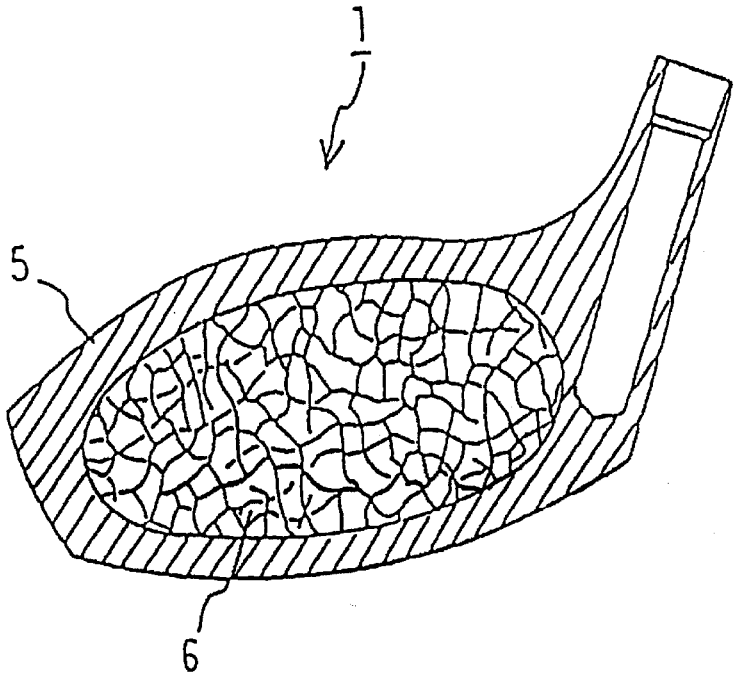
FIG. 4 is a sectional view showing still another embodiment of a driver head for golf relating to the present invention.

Referring to FIG. 4, a sectional view showing still another embodiment of driver head 1 relating to the present invention is illustrated. Driver head 1 relating to the embodiment of FIG. 4 illustrates a metal outer shell 5 having a hollow portion and core 6 arranged in the hollow portion.

Core 6 is produced by distributing thermosetting adhesive over a required number of small pieces of aluminum plate or small masses of foamed aluminum, and putting the small pieces of aluminum plate or small masses of foamed aluminum into a mold to be molded by heat-compression. Thus, core 6 can be produced without any machining such as cutting.

As for the size and number of small pieces of aluminum plate or small masses of foamed aluminum, it is preferable to calculate a specific gravity of about 0.9 for driver head 1. This is almost the same specific gravity as that of persimmon club heads, with core 6 covered with metal outer shell 5.

There is no limitation for thermosetting adhesive to be used and any of the above mentioned thermosetting adhesives can be selected suitably for use.

To cover core 6 with metal outer shell 5, a method can be favorably adopted such that core 6 is set in a mold with a chaplet and molten metal is then poured into the mold to infold core 6. With infolding, it is preferred to cover core 6 with metal sheet to prevent core 6 from high temperature of molten metal.

To cover core 6 with metal material, the present invention can adopt another method such that the metal outer shell 5 is divided into plural members and affixed to core 6 by means such as welding, adhesion, pressure welding, brazing, and fastening with bolts or rivets.

As for the material of metal outer shell 5, any material can be generally used for driver heads, and any of the above mentioned materials can be preferably used.

While the present invention has been described in terms of the formation of a driver head for golf, one skilled in the art will realize that the structure and techniques of the present invention can be applied to many similar appliances. The present invention may be applied in any situation where specific gravity is to be controlled.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A driver head for golf comprising:

a main body as a core member, said core member comprising a required number of small pieces of aluminum plate or small masses of foamed aluminum, said small pieces of aluminum plate or small masses of foamed aluminum compression molded and electric current welded to each other in order to have a specific gravity for said head of about 0.9.

2. A driver head for golf comprising:

a main body as a core member having a face portion and a sole portion, said core member comprising a required number of small pieces of aluminum plate or small masses of foamed aluminum, said small pieces of aluminum plate or small masses of foamed aluminum being compression molded and electric current welded to each other, wherein at least said face portion and said sole portion of said main body are covered with another material, in order to have a specific gravity for said head of about 0.9.

3. A driver head for golf comprising:

a main body as a core member, said core member comprising a required number of small pieces of aluminum plate or small masses of foamed aluminum, over which thermosetting adhesive is distributed, said small pieces of aluminum plate or small masses of foamed aluminum being heat-compression molded in order to have a specific gravity for said head of about 0.9.

4. A driver head for golf comprising:

a main body as a core member having a face portion and a sole portion, said core member comprising a required number of small pieces of aluminum plate or small masses of foamed aluminum, over which thermosetting adhesive is distributed, said small pieces of aluminum plate or small masses of foamed aluminum being heat-compression molded, wherein at least said face portion and said sole portion of said main body are covered with another material, in order to have a specific gravity for said head of about 0.90.

5. A driver head for golf comprising:

a metal outer shell having a hollow portion; and a core arranged within the hollow portion, said core comprising a required number of small pieces of aluminum plate or small masses of foamed aluminum, over which a thermosetting adhesive is distributed, said small pieces of aluminum plate or small masses of foamed aluminum being heat-compression molded in order to have a specific gravity for said head of about 0.9.

* * * * *